US005976019A

United States Patent [19]

Ikeda et al.

[11] Patent Number: 5,976,019

[45] Date of Patent: Nov. 2, 1999

[54] RUNNING SIMULATION APPARATUS

[75] Inventors: Yuji Ikeda; Susumu Murata; Shunichi Nakamura; Shinya Saito; Kaoru Igarashi, all of Tokyo, Japan

[73] Assignee: Sega Enterprises, Ltd., Tokyo, Japan

[21] Appl. No.: 08/817,766

[22] PCT Filed: Sep. 13, 1996

[86] PCT No.: PCT/JP96/02621

§ 371 Date: Sep. 25, 1997

§ 102(e) Date: Sep. 25, 1997

[87] PCT Pub. No.: WO97/10034

PCT Pub. Date: Mar. 20, 1997

[30] Foreign Application Priority Data

| | | | |
|---|---|---|---|
| Sep. 13, 1995 | [JP] | Japan | 7-260834 |
| Jan. 8, 1996 | [JP] | Japan | 8-017039 |
| Jul. 25, 1996 | [JP] | Japan | 8-196584 |

[51] Int. Cl.[6] ..... A63H 18/14

[52] U.S. Cl. ..... 463/61; 463/58

[58] Field of Search ..... 463/61, 58, 62–69; 446/129, 134–136

[56] References Cited

U.S. PATENT DOCUMENTS

| | | | |
|---|---|---|---|
| 3,823,941 | 7/1974 | Ochi et al. | 463/61 |
| 3,986,296 | 10/1976 | Hamano | 463/61 |
| 5,688,175 | 11/1997 | Matsuura et al. | 463/61 |

FOREIGN PATENT DOCUMENTS

| | | |
|---|---|---|
| 2-71782 | 3/1990 | Japan . |
| 8-164281 | 6/1996 | Japan . |
| 2-71782 | 3/1997 | Japan . |
| 7-28958 | 4/1997 | Japan . |
| 6-36860 | 9/1997 | Japan . |

*Primary Examiner*—Jessica J. Harrison
*Assistant Examiner*—Sheila Clayton
*Attorney, Agent, or Firm*—Dickstein Shapiro Morin & Oshinsky LLP

[57] ABSTRACT

A traveling simulator capable of controlling in real time the movements of model traveling members, irrespective of a traveling speed of a carrier, is disclosed. The model traveling members, modeled after actual traveling objects, are placed moveably on a traveling plate, and the moveable carrier is disposed below the traveling plate. These model traveling members are tracted by the carrier via the attractive force between magnets provided on a lower surface of the traveling members and magnets provided on an upper surface of the carrier. The magnets on the side of the carrier and those, which are opposed to the magnets on the side of the model traveling members consist of magnets rotatable around vertical shafts. These magnets are provided on the sides of the model traveling members and carrier, two each respectively, so that each set of magnets are spaced from each other. Motors for rotating the magnets are provided on the carrier, and a conversion mechanism for converting the rotational movements of the magnets into predetermined actions of predetermined portions of the modeled traveling members are provided on the sides of the modeled traveling members.

10 Claims, 14 Drawing Sheets

RUNNING SIMULATION APPARATUS

TECHNICAL FIELD

The present invention relates to a game apparatus simulating a horse race, a car race, a boat race, a motorcycle race or the like for amusing oneself by presuming finishing orders, or an amusement apparatus on which a plurality of individuals such as simulated members of a drum and fife band move independently of each other, and particularly to a running simulation apparatus used in the game or amusement apparatus.

BACKGROUND ART

Hitherto, such running simulation apparatuses disclosed in Japanese Patent Publication No. Hei 7-28958 or Japanese Utility Model Publication No. Hei 6-36860 are known. In the running simulation apparatus, a model running body simulating a running body such as a horse with a jockey riding is placed on a running plate so as to run, a carrier capable of running is arranged beneath the running plate, and the model running body is drawn by the carrier through a magnetic attractive force acting between a magnet provided on a lower surface of the model running body and a magnet provided on an upper surface of the carrier.

In the race horse model apparatus disclosed in the above publications, the model horse is supported on a mount carriage having wheels and front and rear legs of the model horse or front and rear legs of the model horse and both arms of the model jockey are swung by the wheel through a crank device when the wheel turns to simulate running of an actual horse and action of an actual jockey.

Further, a race horse model apparatus similar to the above-stated apparatus is disclosed in Japanese Patent Laid-Open Publication No. Hei 2-71782. In this apparatus, simulation of actions of the horse and jockey is realized by magnets provided on the model running body side and the carrier side respectively and capable of turning round vertical axes, other than the above-stated wheel.

That is, when the magnet on the carrier side is turned by a motor, the magnet on the model running body side turns following the former magnet, and the turning motion of the latter magnet is converted through a cam mechanism to neck swinging motion of the model horse and up-and-down motion of the model jockey, for example.

In the customary running simulation apparatus as described in the above Japanese patent publication No. Hei 7-28758 or Japanese utility model publication No. Hei 6-36860, the model running body moves when the wheel of the mount carriage supporting the model running body is turned by friction against the running plate and the moving speed is in accordance with the turning speed of the wheel or the running speed of the carrier, therefore it is not always possible to simulate the motion with fidelity.

For example, when the carrier stops, namely, when the model running body stops, it is impossible to make the running body do some motion. In addition, because the motion speed of the model running body depends on the running speed of the carrier, if a high motion speed of the model running body is wanted, the running speed of the carrier also must be high and if a low motion speed is wanted, the running speed also must be low. It is impossible to quicken the motion of the model running body without changing the running speed of the carrier especially to give an increased speed feeling.

Compared with this, in the customary running simulation apparatus described in the Japanese Patent Laid-Open Publication No. Hei 2-71782, as motion of the model running body is given by the motor for turning the magnet on the carrier side independently of running, stopping or running speed of the carrier, it is possible to simulate actual motions more faithfully or more effectively.

However, the running simulation apparatus requires some means for preventing relative rotation of the model running body and the carrier. If such a rotation preventing means is not provided, as well known in a toy with a doll dancing while turns for example, the whole model running body turns when the magnet turns and it is impossible to convert the rotation of the magnet to a motion of a predetermined part of the model running body. Therefore, in the running simulation apparatus, fixed magnets for traction similar to those in the former prior art are provided on the model running body side and carrier side in addition to the rotary magnet, to prevent the relative rotation of the both and enable a linear motion of the model running body.

Namely, the latter prior art corresponds to the former prior art whose wheel is converted into a rotary magnet, and in both prior arts, the model running body has means for traction and means for motion formed and arranged separately, therefore the model running body becomes large-size. Further, since motions are given to some parts of the running body, to the model horse and the model jockey for example, by the same wheel or rotary magnet, it is impossible to give the model horse and the model jockey motions which are independent of each other, respectively. For example, the model jockey cannot whip the horse at a voluntary timing in such a manner that the model jockey whips directly after starting and again whips before the goal, and if it is intended to make the model jockey whip, the model jockey continues to whip from the start to the last.

DISCLOSURE OF INVENTION

Accordingly, one object of the present invention is to provide a running body model apparatus capable of controlling motion of a model running body in real time independently of running speed of a carrier. Another object is to provide a running body model apparatus in which a plurality of model bodies forming a model running body can be given respective independent motions. Other object of the invention is to provide a running body model apparatus in which the whole model running body can be formed in relatively small size, and moreover can be given various motions.

According to the present invention, there is provided a running simulation apparatus having a model running body simulating a running body running with various motions placed on a running plate so as to run, a carrier capable of freely running arranged under the running plate, and magnets provided on a lower face of the model running body and on a upper face of the carrier respectively for drawing the model running body by the carrier through a magnetic attractive force acting between the magnets, comprising: a plurality of magnets capable of turning about a vertical axis provided on the model running body at a regular interval; a plurality of magnets capable of turning about a vertical axis provided on the carrier at a regular interval; turning drive means provided on the carrier for driving the magnets of the carrier side to turn; and a movement transformation mechanism provided on the model running body for transforming turning movement of the magnets of the model running body side into a predetermined motion of a predetermined part of the model running body.

In this invention, similarly to the prior art, traction force is transmitted from the carrier side to the model running body side by attraction force acting between the magnets of the model running body side and the carrier side, but in addition to this, the magnets of the both sides are capable of turning about vertical axes and a motor (turning drive means) for driving the magnets of the carrier side is provided so that rotation of the motor is transmitted to the magnets of the model running body side through the magnets of the carrier side, and the rotation is transformed into a suitable motion by the movement transformation mechanism and transmitted to a predetermined part of the model running body to give the part a predetermined motion. The model running body and the carrier have respective plurality of magnets corresponding to each other and turning direction of the magnets can be controlled in normal or reverse. There is no fear that the whole model running body turns about a turning axis of a magnet relatively to the carrier, and the model running body is given a predetermined motion surely and can be run stably.

Namely, according to the present invention, exclusive magnets for traction can be omitted by providing two or more magnets for transmitting rotary movement. Thus, motions of the model running body can be controlled from the carrier side utilizing the magnets for drawing the model running body.

Since operation of the motor for driving the magnets of carrier side can be controlled freely independently of running of the carrier, motion of the model running body can be controlled by the motor in real time independently of running speed of the carrier.

If each of the magnets of the carrier side is provided with a motor respectively and each of the magnets of the model running body side is provided with a movement transformation mechanism respectively, the model running body can be given various kinds of motions independent of each other, further, if the motors can be controlled to rotate in both normal and reverse directions, the number of available motions can be doubled.

THE BEST MODE FOR CARRYING OUT THE INVENTION

Figure 1:
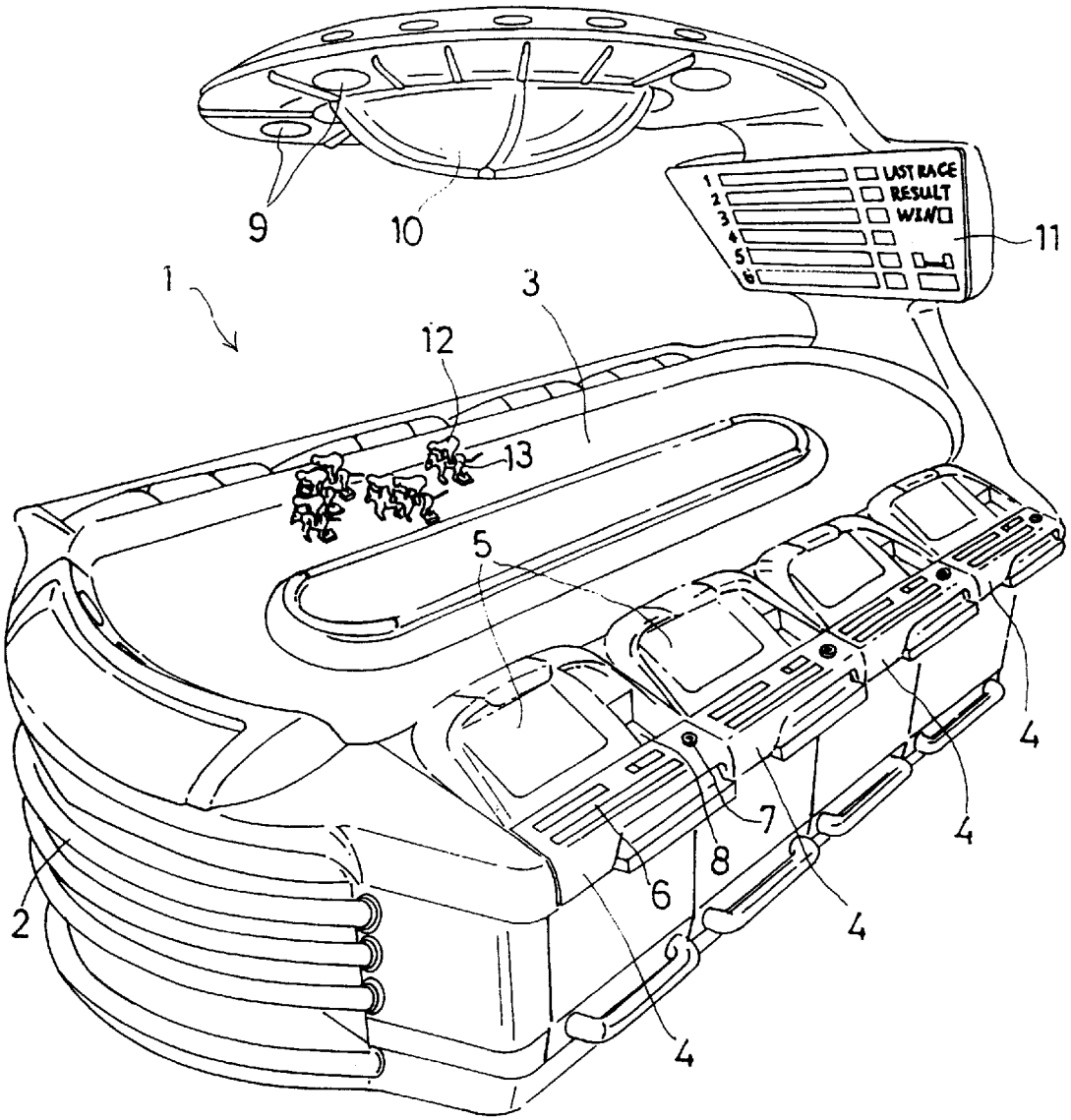
FIG. 1 is a whole outside view of a horse race game apparatus according to the present invention.

FIG. 1 is a whole outside view of a horse race game apparatus 1 according to the present invention. An annular running plate 3 simulating a track is affixed on an upper face of an oblong base pedestal 2 and on both sides of the pedestal 2 are arranged four satellites 4 respectively. Each satellite 4 is equipped with a monitor 5, a operation panel 6, a medal slot 7 and a medal return 8. A player can vote for an expectant prize-winning horse in single or plural by manipulating the operation panel 6. 9 and 10 denote a speaker and an illuminator respectively. 11 denotes a display on which introductions, numbers, frameworks, bet rates or the like of horses are displayed.

Figure 2:
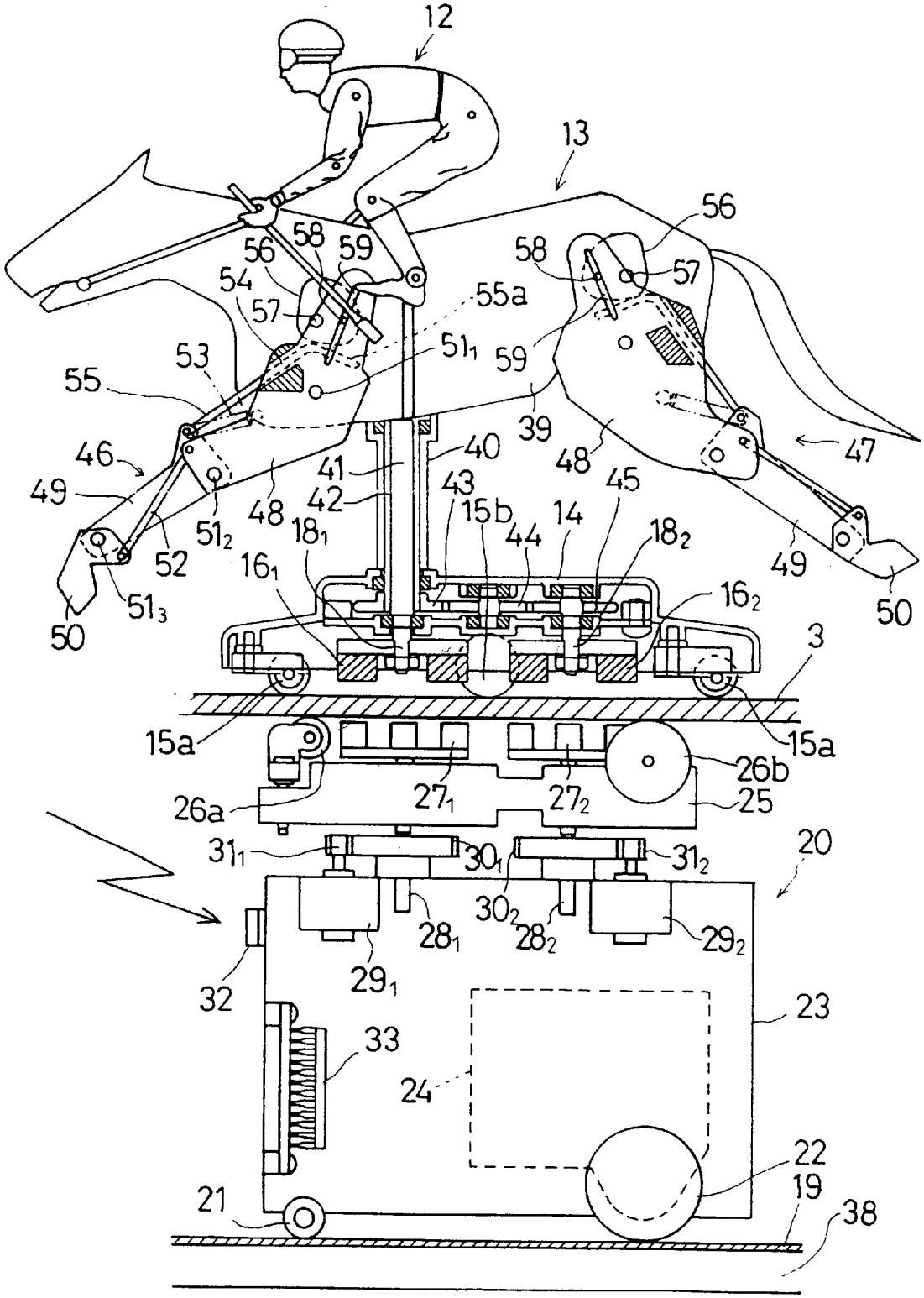
FIG. 2 is a side view of a model running body composed of a model jockey and a model horse and a carrier for drawing it.

Six model horses 13 with model jockeys riding run on the running plate 3. As shown in FIG. 2, the model jockey 12 and the model horse 13 are supported on a mount carriage 14 and constitute a model running body in the present invention together with the mount carriage 14. The mount carriage 14 is placed on the running plate 3 so as to be run by means of front and rear wheels 15*a*, 15*a* and wheels 15*b*, 15*b* pivoted at the both sides. The wheels 15*a*, 15*a* are pivoted at tip ends of arm members swingable about vertical axes and can change their running direction smoothly.

Figure 3A:
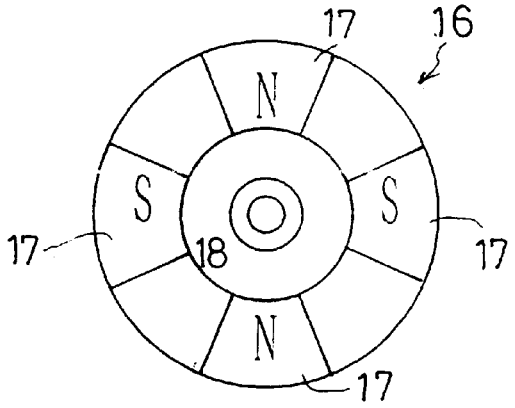
FIGS. 3A and 3B are end views of rotary magnets.
Figure 3B:
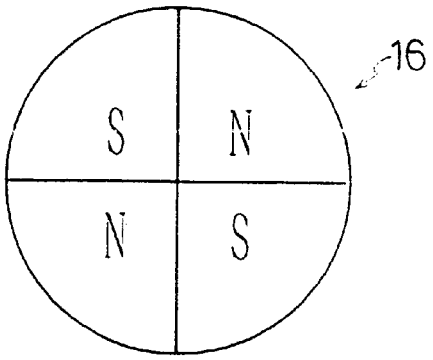

The mount carriage 14 is provided with two rotary magnets $\mathbf{16}_1$, $\mathbf{16}_2$ arranged in front-and-rear direction being somewhat distant from the upper surface of the running plate 3. As shown in FIG. 3A, each rotary magnet 16 is formed by four magnet pieces 17 arranged in a circular shape. Neighboring magnet pieces 17 have distinct N-S polarities. The rotary magnets $\mathbf{16}_1$, $\mathbf{16}_2$ are pivotally supported on the mount carriage 14 by means of rotary shafts $\mathbf{18}_1$, $\mathbf{18}_2$ fixedly passing through center portions of the magnets $\mathbf{16}_1$, $\mathbf{16}_2$. As shown in FIG. 3B, the rotary magnet 16 may have a circular section divided into even sectors magnetized in distinct polarities in order.

As shown in FIG. 2, an annular lower running plate 19 similar to the running plate 3 is spread under the running plate 3 leaving a space therebetween. A carrier 20 to each model running body (12, 13, 14) is placed on the lower running plate 19 so as to run and draw the model running body (12, 13, 14) on the running plate 3.

The carrier 20 has a carrier main body 23 placed on the lower running plate 19 so as to be run by means of front wheels 21 and a rear wheel 22. The front wheels 22 are provided at both sides of the carrier main body 23 making a pair and drivingly connected to respective running motors 24. Therefore, when the both motors 24 are driven to turn at the same speed, the carrier main body 23 goes straight on, and when the motors 24 are driven at different speeds, the carrier main body 23 turns to right and left for changing its running direction. Alternatively, a running motor 24 common to the right and rear wheels 22 and a steering motor connected to the front wheel 21 for changing the running direction may be provided.

On a top of the carrier main body 23 is provided a support mount 25 forced upward by a spring device (not shown) and front and rear wheels 26*a*, 26*b* pivoted at an upper face portion of the support mount 25 are engaged with a lower surface of the running plate 3. Therefore, the carrier 20 is interposed between the lower running plate 19 and the running plate 3 through the wheels 21, 22 and the wheels 26*a*, 26*b* so that the carrier 20 can run freely within the space between the both running plates 19, 3 always maintaining a correct upright posture.

Rotary magnets $\mathbf{27}_1$, $\mathbf{27}_2$ distant from the under surface of the running plate 3 a little are arranged at positions between the wheels 26*a*, 26*b* and corresponding to the positions of the rotary magnets $\mathbf{16}_1$, $\mathbf{16}_2$ of the mount carriage 14 on the running plate 3. The rotary magnets $\mathbf{27}_1$, $\mathbf{27}_2$ are constructed in the quite same manner as the rotary magnets $\mathbf{16}_1$, $\mathbf{16}_2$ (see FIG. 3). The rotary magnets $\mathbf{27}_1$, $\mathbf{27}_2$ have rotary shafts $\mathbf{28}_1$, $\mathbf{28}_2$ extending vertically through the support mount 25 and pivoted to the carrier main body 23 at the lower ends. Motors $\mathbf{29}_1$, $\mathbf{29}_2$ for rotationally driving the rotary magnets $\mathbf{27}_1$, $\mathbf{27}_2$ (hereinafter called as turning motors) are provided on the carrier main body 23. The rotary shaft $\mathbf{28}_1$ is connected to the turning motor $\mathbf{29}_1$, through gears $\mathbf{30}_1$, $\mathbf{31}_1$, and the rotary shaft $\mathbf{28}_2$ is connected to the turning motor $\mathbf{29}_2$ through gears $\mathbf{30}_2$, $\mathbf{31}_2$ Alternatively, the turning motors may be provided on the support mount and directly connected to the rotary magnets.

The carrier 20 is supplied with electricity by means of an electric collector (not shown) projected from the support mount 25 and coming in contact with a electric supply plate (not shown) spread on the lower surface of the running plate 3, for example. In addition, the carrier 20 has a light receiver 32 and driving of the above-mentioned motors 24, $\mathbf{29}_1$, $\mathbf{29}_2$ is controlled by infrared control signal received by the light receiver 32. For this purpose, a microcomputer 33 is equipped in the carrier main body 23.

Figure 4:
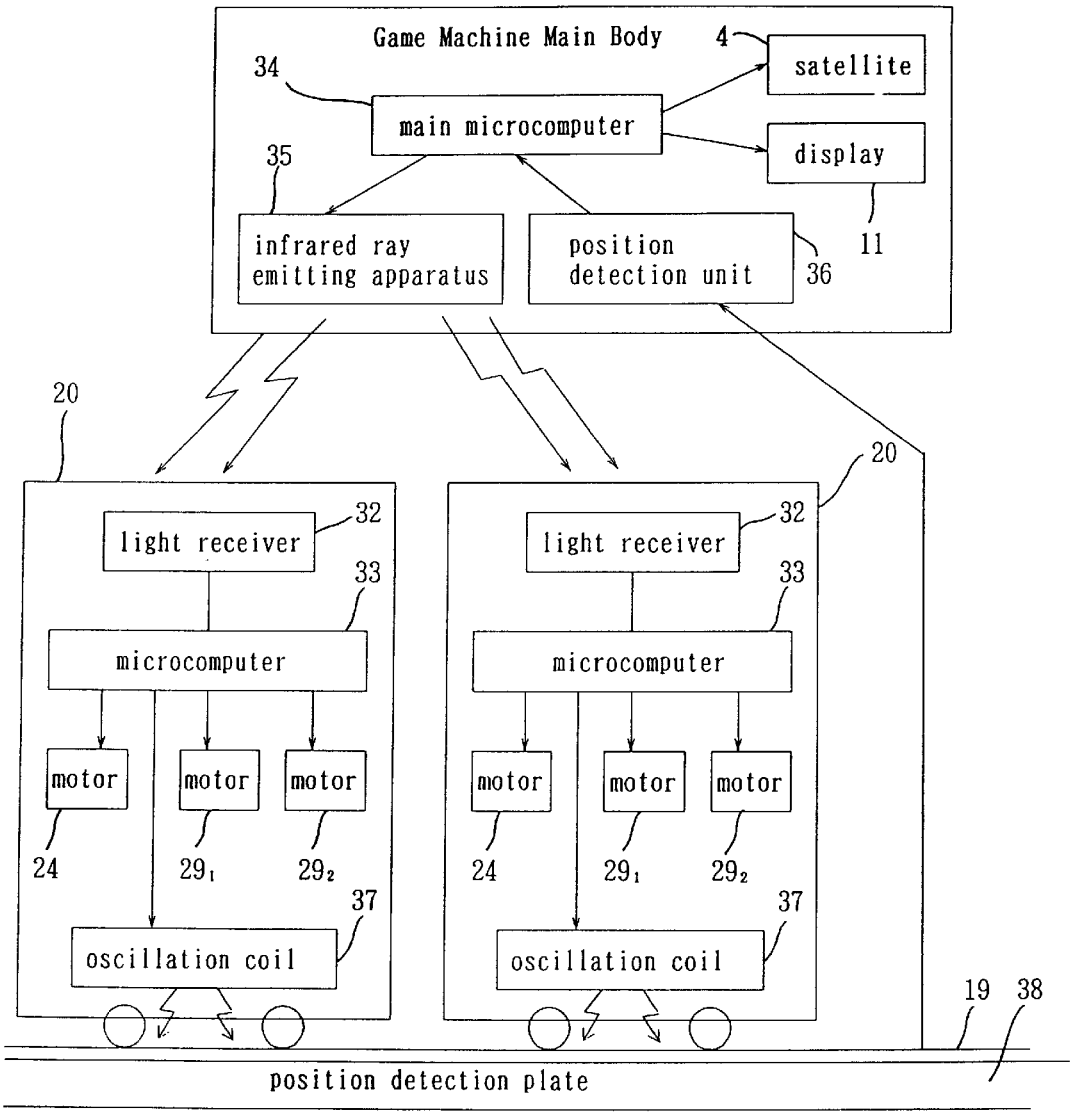
FIG. 4 is a rough block diagram of a control system.

FIG. 4 is a rough block diagram of a control system for controlling the carriers 20. The game machine main body is equipped with a main microcomputer 34 which selects race developments and carries out main controls of the whole system, the above-mentioned satellite 4, the display 11, an infrared ray emitting apparatus 35 for transmitting the infrared control signal to the carriers and a position detection unit 36 for detecting positions of the carriers.

The infrared signal from the infrared ray emitting apparatus 35 is received by the light receiver 32 on the carrier 20 side and inputted to the microcomputer 33 which analyzes the inputted signal and outputs driving control signals to the motor 24 and the turning motors $\mathbf{29}_1$, $\mathbf{29}_2$. The carrier 20 has also an oscillation coil 37 for position detection and the microcomputer 33 outputs a control signal to the oscillation coil 37 too. The above-mentioned infrared signals are time sharing serial control signals and frames corresponding to the carriers 20 are transmitted serially. The microcomputer 33 decodes the signals and when it is judged that signals are those for the proper carrier, outputs control signals based on the instructions to the motors 24, $\mathbf{29}_1$, $\mathbf{29}_2$ and the oscillation coil 37.

The carrier 20 can be run in any direction and at any speed on the lower running plate 19 by suitably controlling a pair of right and left running motors 24. Beneath the lower running plate 19 are spread a position detection plate 38 connected with the position detection unit 36. When the oscillation coil 37 is oscillated, the oscillation is received by the position detection plate 38 and the position detection unit 36 detects the position on the position detection plate 38 where the oscillation is received to recognize positions of the carriers 20. The detection signal of the position detection unit 36 is fed back to the main microcomputer 34.

The turning motors $\mathbf{29}_1$, $\mathbf{29}_2$ are rotationally controlled on the basis of the aforementioned infrared signals independently of each other and independently of the running motors 24 too. The rotation of the turning motor $\mathbf{29}_1$ is transmitted to the rotary magnet $\mathbf{27}_1$, through the gears $\mathbf{31}_1$, $\mathbf{30}_1$, and to the rotary shaft $\mathbf{28}_1$, and the rotation of the turning motor $\mathbf{29}_2$ is transmitted to the rotary magnet $\mathbf{27}_2$ through the gears $\mathbf{31}_2$, $\mathbf{30}_2$ and to the rotary shaft $\mathbf{28}_2$. At the upper side of the running plate 3, the rotary magnets $\mathbf{16}_1$, $\mathbf{16}_2$ on the mount carriage 14 are opposite to the rotary magnets $\mathbf{27}_1$, $\mathbf{27}_2$ so that the rotary magnet $\mathbf{27}_1$ and the rotary magnet $\mathbf{16}_1$ are turned in a body by magnetic action between them and the rotary magnet $\mathbf{27}_2$ and the rotary magnet $\mathbf{16}_2$ are also turned in a body similarly. That is, the aforementioned rotations of the rotary magnets $\mathbf{27}_1$, $\mathbf{27}_2$ are transmitted to the rotary magnets $\mathbf{16}_1$, $\mathbf{16}_2$ as they are. Since magnetic lines of force between the rotary magnets $\mathbf{27}_1$, and $\mathbf{16}_1$, and between the rotary magnets $\mathbf{27}_2$ and $\mathbf{16}_2$ are closed in itself, the rotary magnets $\mathbf{27}_1$ and $\mathbf{27}_2$ and the rotary magnets $\mathbf{16}_1$ and $\mathbf{16}_2$ don't interfere with each other and rotations of the rotary magnets $\mathbf{27}_1$ and $\mathbf{27}_2$ are correctly transmitted to the rotary magnets $\mathbf{16}_1$, and $\mathbf{16}_2$ respectively. Since the mount carriage 14, namely the model running body, has two rotary magnets $\mathbf{16}_1$, $\mathbf{16}_2$ apart from each other and the rotary magnets $\mathbf{16}_1$, $\mathbf{16}_2$ are attracted by the rotary magnets $\mathbf{27}_1$, $\mathbf{27}_2$ of the carrier side respectively, each of the two rotary magnets $\mathbf{16}_1$, $\mathbf{16}_2$ prevents the model running body (14, 13, 12) from turning as a whole about an axis of another rotary magnet. Therefore, the model running body (14, 13, 12) does not rotate relatively to the carrier 20 and follows running of the carrier stably and faithfully.

On the one hand, the mount carriage 14, namely the model running body, is drawn by the carrier 20 through attracting forces between the rotary magnets $\mathbf{27}_1$, and $\mathbf{16}_1$, and between the rotary magnets $\mathbf{27}_2$ and $\mathbf{16}_2$ irrespective of whether the rotary magnets turn or not to carry out, on the running plate 3, the same running movement as the carrier 3. When alignment of the model running body and the carrier is missed, the microcomputer 33 of the carrier 20 can detect it by difference of electric currents flowing in the turning motor 29 before and after. Also, the missing of the alignment can be detected by up-and-down movement of the model running body.

Figure 16:
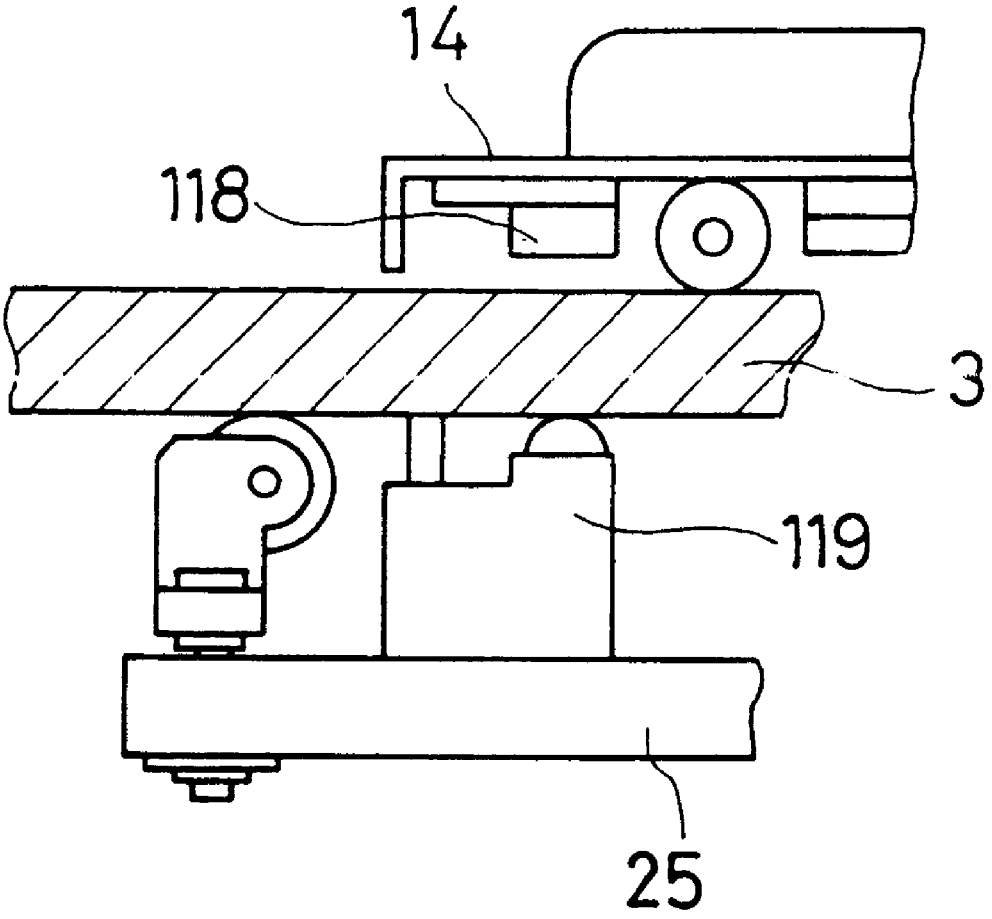
FIG. 16 is a partial side view showing means for detecting alignment of the model running body and the carrier.

Alternatively, as shown in FIG. 16, a magnet piece 118 may be provided on a front under surface of the mount carriage 14 and at a position on the support mount 25 of the carrier 20 opposite to the magnet piece 118 may be provided a hall effect device which ia a semiconductor electronic part for taking out intensity of magnetic field as an electric signal utilizing hall effect. When the mount carriage comes away the carrier or the mount carriage is placed reversely in before and behind, it can be detected by change of the hall voltage according to the hall effect.

Hereinafter, the structure of the model running body composed of the model jockey 12, the model horse 13 and the mount carriage 14 will be explained in more detail. The model horse 13 has a trunk part 39 supported on the mount carriage 14 by means of a tubular support member 40. Within the support member 40, a first drive shaft 41 extends vertically at the center portion and a tubular second drive shaft 42 extends vertically surrounding the first drive shaft 41. The drive shafts 41, 42 are capable of turning independently of each other. The lower end of the first drive shaft 41 is integrated with the rotary shaft $\mathbf{18}_1$, of the rotary magnet $16_1$, therefore the first drive shaft 41 is rotationally driven by the rotary magnet $16_1$.

At the lower end of the second drive shaft 42 positioned above the rotary magnet $16_1$ is provided a driven gear 43. The driven gear 43 is meshed with a neighboring intermediate gear 44 and the gear 44 is meshed with a drive gear 45 provided on the rotary shaft $18_2$ of the rotary magnet $16_2$. That is, the drive shaft 42 is rotationally driven by the rotary magnet $16_2$ in the same direction.

On the trunk part 39 of the model horse 13 are provided front legs 46 and rear legs 47 so as to swing. Each of the legs is composed of a thigh portion 48, a leg portion 49 and a foot portion 50, and the thigh portion 48 is pivoted to the trunk part 39 by a pivot $51_1$. The leg portion 49 is pivoted to the thigh portion 48 by a pivot $51_2$ and the foot portion 50 is pivoted to the leg portion 49 by a pivot $51_3$. Further, the thigh portion 48 and the foot portion 50 are connected to each other by a connecting rod 52, a spring 53 is stretched between the leg portion 49 and the thigh portion 48 , and a lower end of a rod member 55 which is slidably inserted in a guide hole 54 formed in the thigh portion 48 is connected to the leg portion 49. An upper end portion of the rod member 55 is bent to form a cam contact surface 55a abutting on a cam face of a cam member 56. The cam member 56 is pivoted to the trunk part 39 by a shaft 57, and a projection 58 provided on the cam member 56 positioned at a distance from the shaft 57 is engaged with a long guide slot 59 formed in the thigh portion 48.

Figure 5:
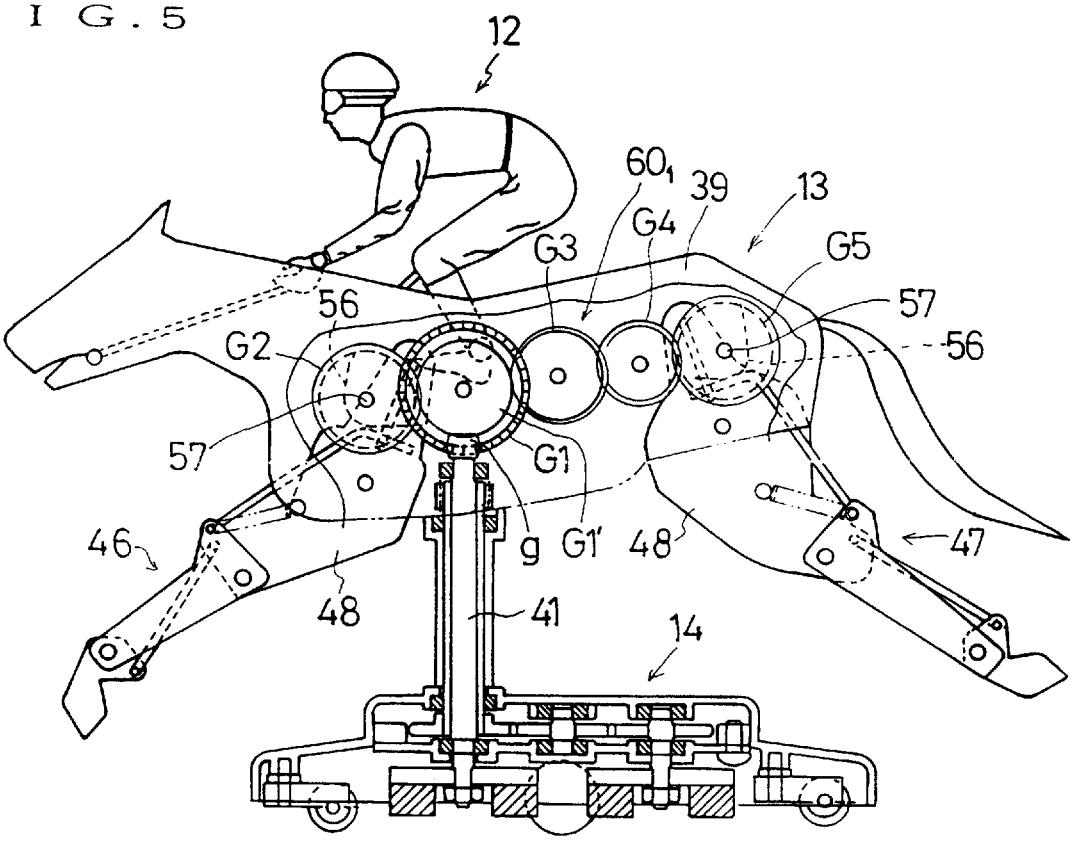
FIG. 5 is a side view showing a movement transformation mechanism for simulating motion of the horse legs.

The inside of the trunk part 39 is made into a cavity in which an upper part of the thigh portion 48 is positioned. In addition, a movement transformation mechanism $60_1$, for transforming rotation of the first drive shaft 41 into open-close movement of the front and rear legs 46, 47 is arranged within the cavity (FIG. 5). The movement transformation mechanism $60_1$ has a bevel gear G1 capable of rotating about a horizontal axis extending right and left above the first drive shaft 41, and a small bevel gear g provided on the upper end of the first drive shaft 41 is engaged with the bevel gear G1. Therefore, the rotation of the first drive shaft 41 is transformed into a rotation about the horizontal axis extending right and left by the bevel gear G1.

Figure 6:
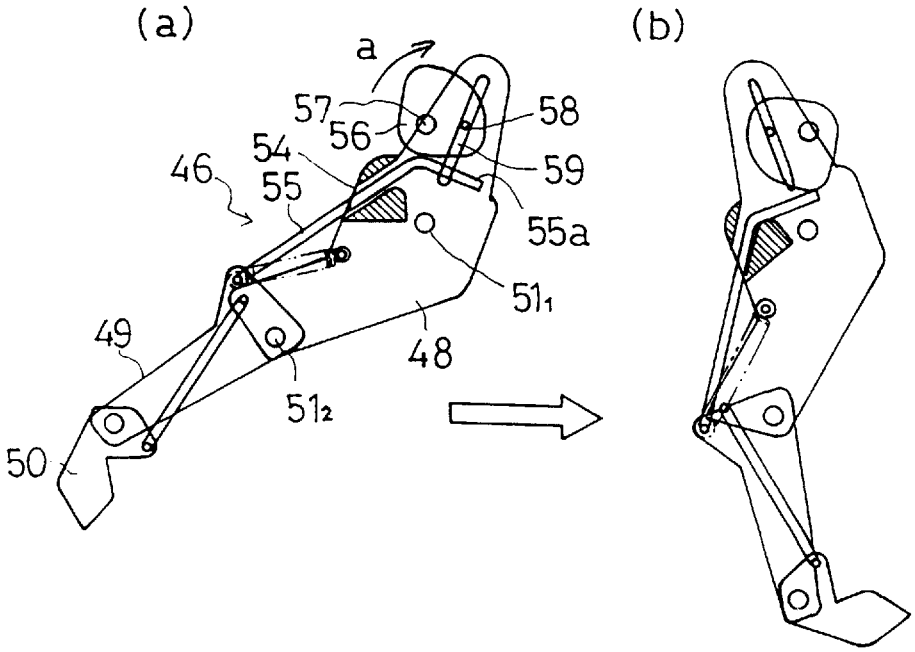
FIGS. 6(*a* ) and 6(*b* ) are an explanatory view showing open-close motion of the horse legs.

The bevel gear G1 has a spur gear G1' formed integrally and gears G2, G3 are engaged with the gear G1' at the front and rear. The shaft 57 of the cam member 56 for the front leg 46 serves as the shaft of the gear G2 so that the cam member 56 is rotated integrally with the gear G2. FIGS. 2, 5 show a leg opening state of the model horse 13 in which the front legs 46 and the rear legs 47 are stretched toward the front and rear respectively, and FIG. 6(*a*) shows the front leg 46 in the leg opening state. When the gear G2 turns in a direction as shown by an arrow a from this state and at the same time the cam member turns in the same direction, the cam contact surface 55a of the rod member 55 is pushed by the cam face of the cam member 56 to push out the rod member 55 from the guide hole 54 downward so that the leg portion 49 is swung about the pivot $51_2$ rearward. At the same time, since the projection 58 turns about the shaft 57, the thigh portion 48 is swung counterclockwise about the pivot $51_1$. Thus the front leg 46 is brought to a leg closing state as shown in FIG. 6(*b*). When the gear G2 and the cam member 56 continue to turn, the front leg 46 returns to the leg opening state shown in (*a*) again and thereafter repeats the leg closing and the leg opening.

The gear G3 engaged with the gear G1' at the rear side is engaged with a gear G4 and the gear G4 is engaged with a gear G5 in turn. The gear G5 and the cam member 56 of the rear leg 47 have a common shaft and the both turn in a body. While the turning direction of the gear G5 is the same as that of the gear G2, the front leg 46 and the rear leg 47 are formed symmetrically with each other in the front-and-rear direction, so that the rear leg 47 also repeats the leg opening-closing movement in accordance with the leg opening-closing movement of the front leg 46 to simulate running of the horse.

Figure 7:
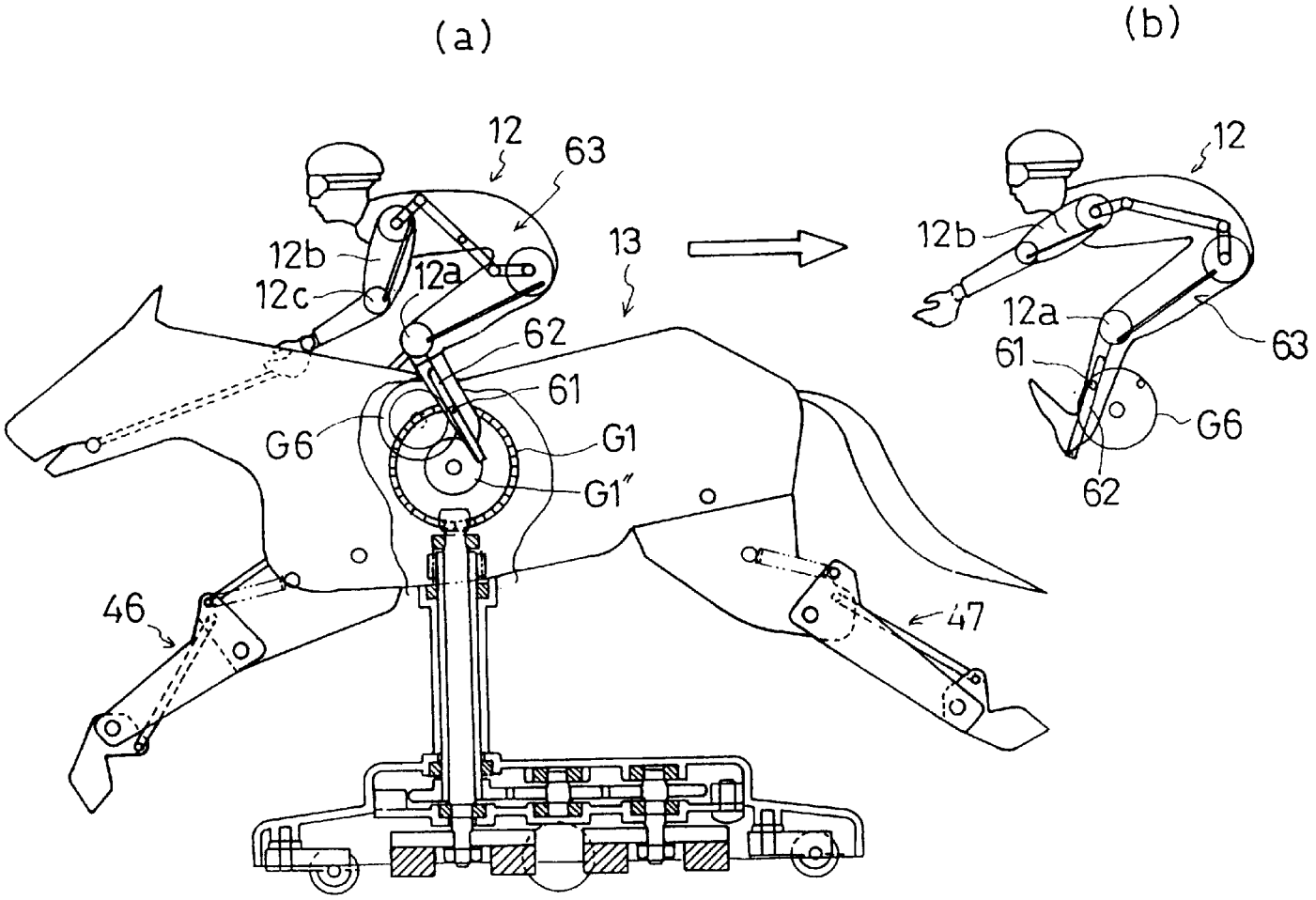
FIGS. 7(*a* ) and 7(*b* ) are a side view showing a movement transformation mechanism for simulating motion of the jockey in running.

As shown in FIG. 7, a gear G6 is meshed with a gear G1" integrated with the aforementioned bevel gear G1 and a projection 61 provided on a periphery of the gear G6 is slidably engaged with a long slot 62 formed along a leg portion of the model jockey 12. Since the model jockey 12 is supported at the knee portion 12*a* on the model horse 13, a leg portion of the model jockey 12 swings in front and behind around the knee portion 12*a* when the projection 61 rotates together with the gear G6. Within the body of the model jockey 12 are arranged link mechanism 63 for coupling various parts to obtain various kinds of motion such as bending movement of the knee portion 12*a*, swinging movement of the arm portion 12*b* and bending movement of the elbow portion 12*c*, so that the model jockey 12 repeats the posture shown in (a) of FIG. 7 and the posture shown in (b) in accordance with the leg opening-closing movement of the front and rear legs 46, 47, thus motions of a jockey when a .ace horse runs are simulated.

Figure 8:
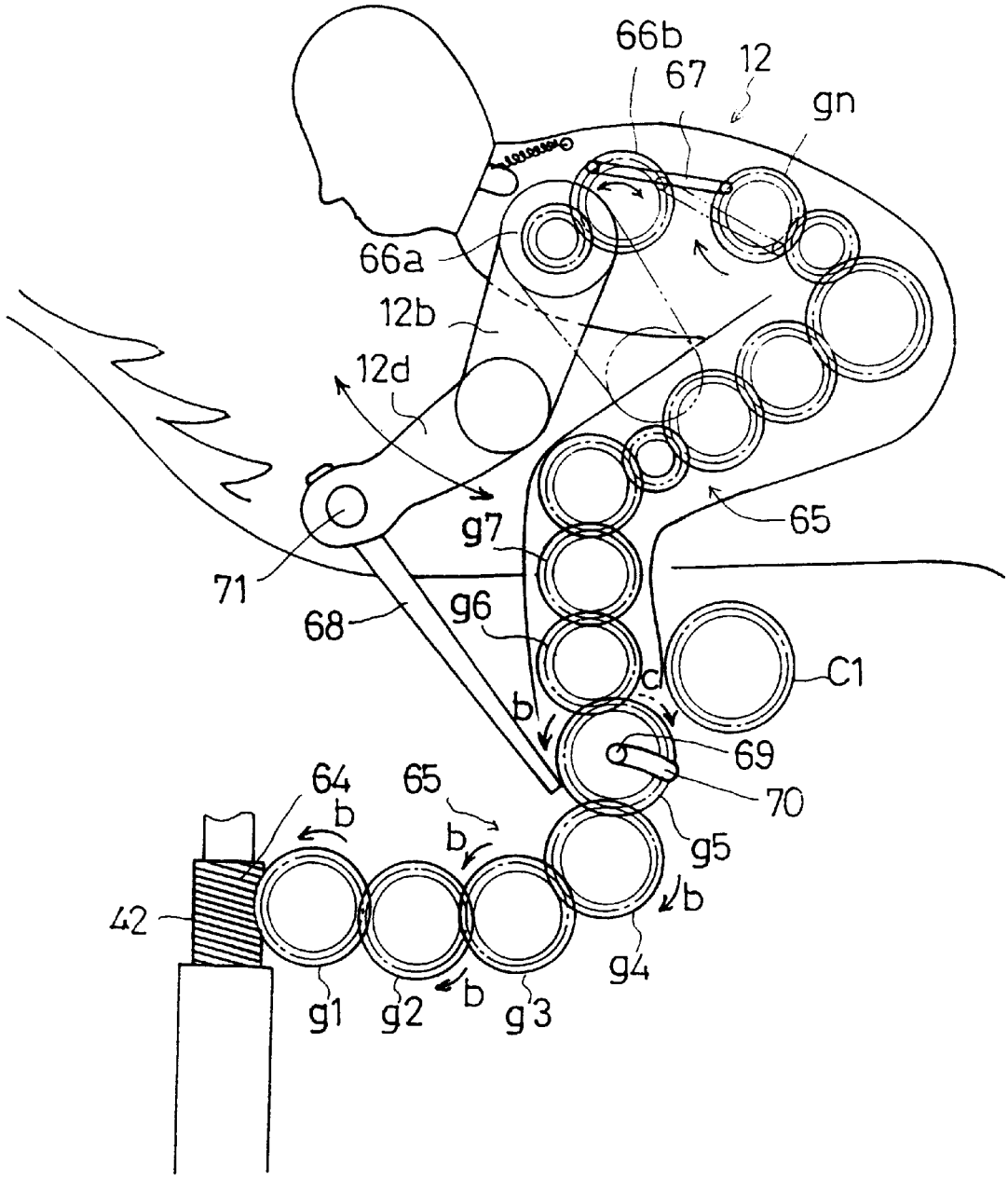
FIG. 8 is a rough sketch showing a movement transformation mechanism for simulating whip motion of the jockey.

As shown in FIG. 8, at an upper end of the second drive shaft is cut a thread 64 meshing with a small gear g1. This small gear g1 is the first gear of, a gear train 95 composed of many similar small gears g2, g3, g4, g5, g6 etc . . . The gear train enters inside of the model jockey 12, extends along it and reaches the last gear gn. The small gear gn is connected to a gear 66*b* through a link member 67 and the gear 66*b* is meshed with a gear 66*a* provided at a base end of the arm portion 12*b* of the model jockey 12. When the small gear gn rotates, the gear 66*b* carries out a swinging motion and in accordance with this, the arm portion 12*b* swings to make a whip 68 connected to the hand portion 12*d* swing up and down, thus whipping of a jockey is simulated.

Among the small gears forming the gear train 65, the small gear g5 has a gear shaft 69 fitted and supported in an arcuate groove 70. When the second drive shaft 42 turns in a predetermined direction and the small gears g1–g5 turn in directions shown by arrows b respectively, the gear shaft 69 of the small gear g5 is supported at the left end of the groove 70 and the small gear g5 is meshed with the small gear g6 to transmit the rotary force to the arm portion 12*b* as stated above. However, when the second drive shaft 42 turns in the reverse direction and the small gear g5 turns in the direction shown by the arrow c, the gear shaft 69 is supported at the right end of the groove 70 and the small gear g5 is disengaged from the gear g6 to intercept the transmission of the rotary force to the arm portion 12*b*, therefore the whipping motion is stopped. At this time, the arm portion 12*b* is returned to a predetermined fixed position by a magnet 71.

Figure 9:
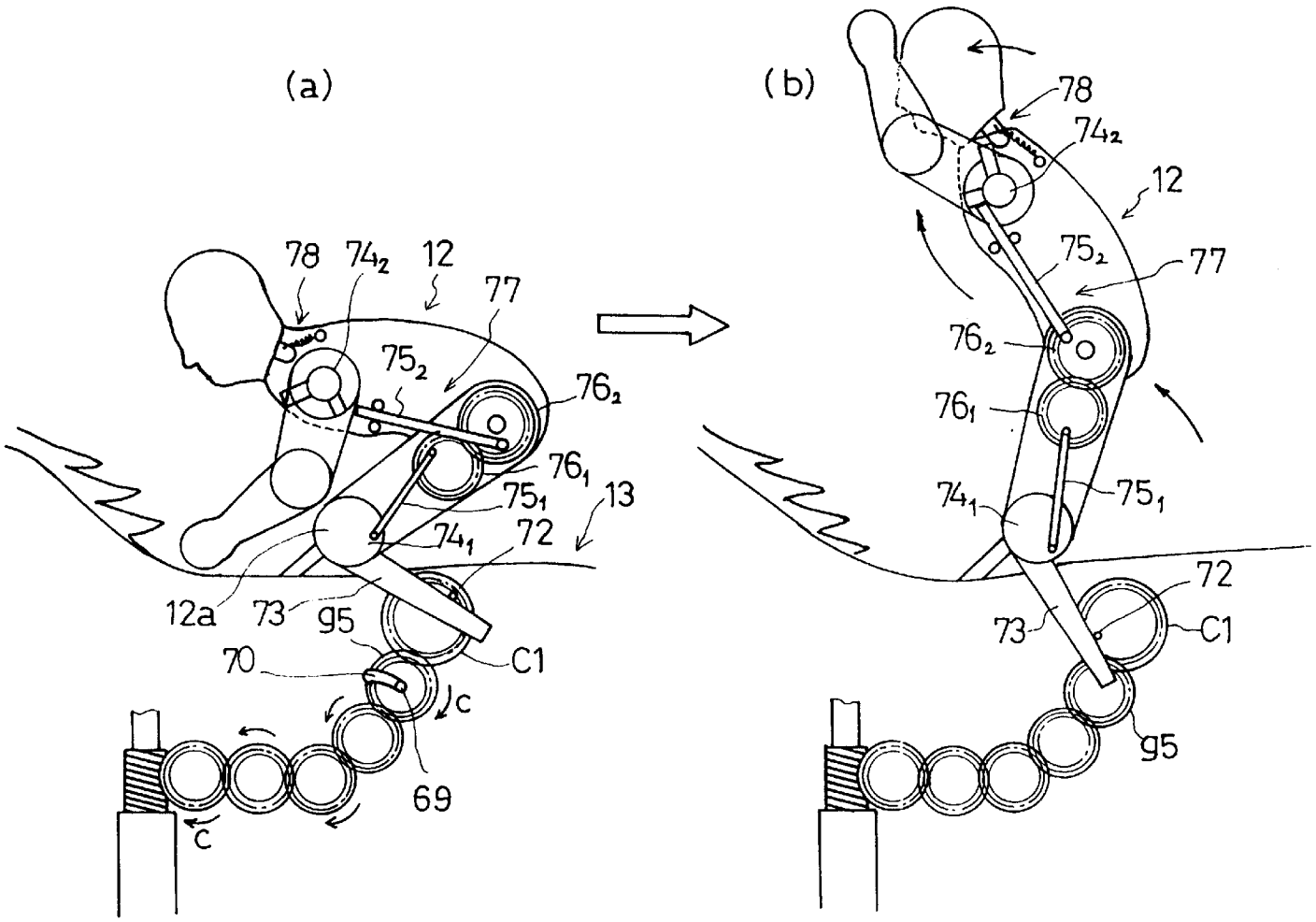
FIGS. 9(*a* ) and 9(*b* ) are a rough sketch showing a movement transformation mechanism for simulating winning pose of the jockey.

When the gear shaft 69 is moved to the right end of the groove 70 as stated above, the small gear g5 is meshed with a small gear C1 which is pivoted neighboring with the small gear g6 (FIG. 9). On one side of a periphery of the small gear C1 is provided a projection 72 which a swing piece 73 swingable about the knee portion 12*a* of the model jockey 12 is engaged with. Within the model jockey 12 are provided a gang mechanism 77 comprising gears $76_1$, $76_2$ and connecting rods 75, $75_2$ connecting a circular plate $74_1$, at a base end part of the swing piece 73 with a circular plate $74_2$ at a base end part of the arm portion 12*b*, and a head shake mechanism 78 to make the model jockey shake its head in accordance with rotation of the circular plate $74_2$. Therefore, in case that the small gear g5 is meshed with the small gear C1, as shown in (a) and (b) of FIG. 9, the model jockey 12 stands up on the horse, shakes up the arm and nods the head, that is, carries out a motion simulating a winning pose. This motion is repeated if the small gear C1 is driven continuously.

As described above, according to the present embodiment, by driving and controlling the rotary magnet $27_1$ to turn with the turning motor $29_1$, the model horse 13 repeats leg-opening and leg-closing to simulate horse running, as well as the model jockey 12 simulates motions of a jockey at running in accordance with the leg-opening and leg-closing motions. Further, when the rotary magnet $27_2$ is driven and controlled to turn in a direction by the turning motor $29_2$, the model jockey 12 simulates the whipping motion and when the rotary magnet $27_2$ is turned in the reverse direction, the model jockey 12 simulates the winning pose. If the turning motor $29_1$, is also made so as to turn in both directions, it is possible to simulate the leg opening-closing at gallop by normal turning of the motor $29_1$ and simulate the leg opening-closing at walk by reverse turning of the motor $29_1$, for example.

Thus, the model jockey 12 and the model horse 13 are capable of simulate many motions to increase actuality. Since these motions are given by controlling the turning motors $29_1$, $29_2$ independently of each other, it is possible to give the motions in real time at any suitable time irrespectively of the running speed of the carrier 20. In addition, the running motion of the horse by the turning motor $29_1$ and the whipping or winning pose motion of the jockey by the turning motor $29_2$ can be given independently of each other.

Figure 10:
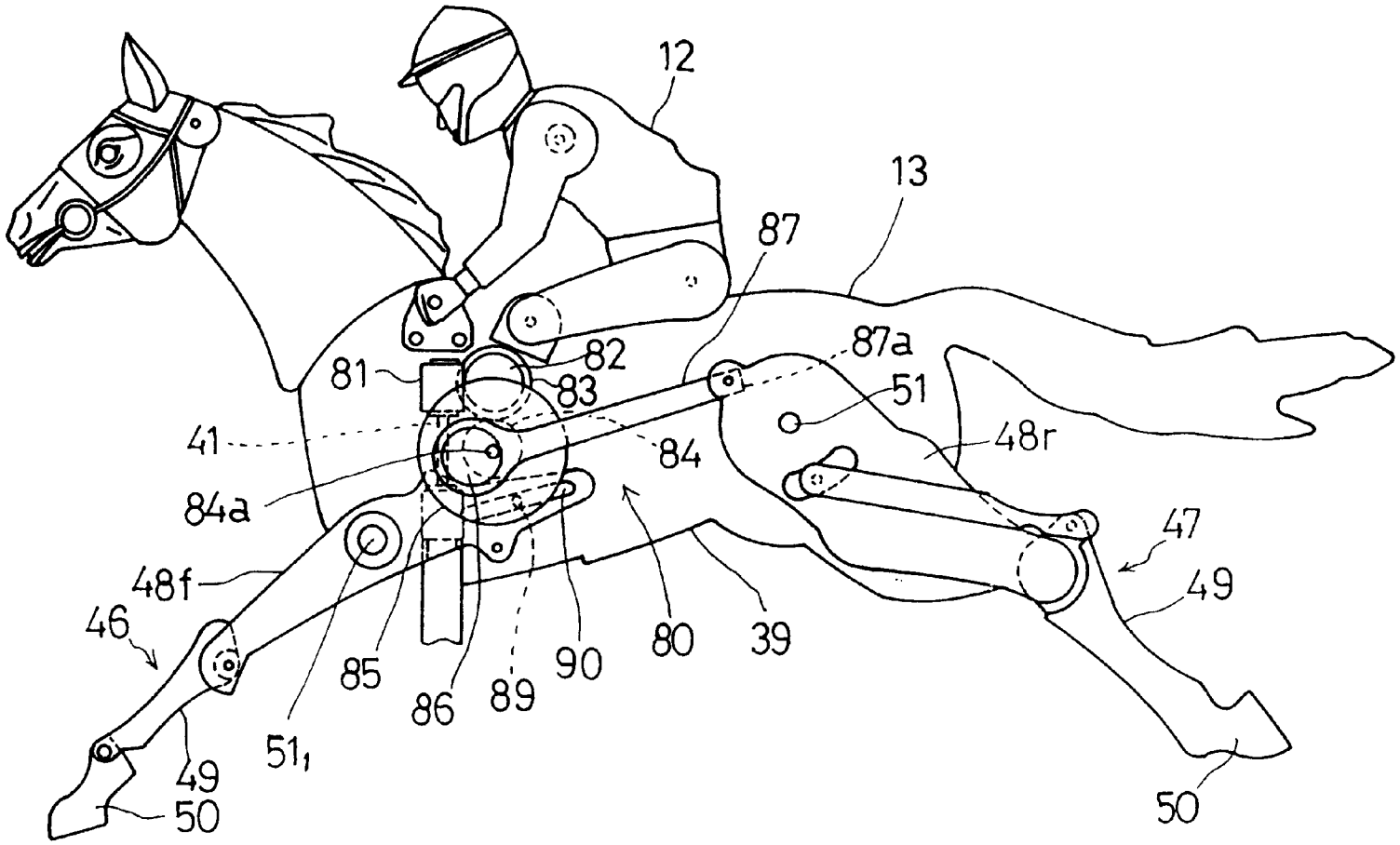
FIG. 10 is a side view showing another movement transformation mechanism for simulating motion of the horse legs.

FIG. 10 is a side view showing another preferred embodiment of the movement transformation mechanism for simulating motion of the horse legs. That is, the movement transformation mechanism 80 of FIG. 10 may be used in place of the movement transformation mechanism $60_1$, of FIG. 5.

According to the present embodiment, the first drive shaft 41 extends upward within the trunk part 39 of the model horse 13 and has a worm 81 at the upper end. The worm 81 is meshed with a worm wheel 82 and a gear 83 coaxial with the worm wheel 82 is meshed with a gear 84. The shaft 84*a* of the gear 84 extends laterally and a circular plate member 85 is concentrically fixed to the tip end of the shaft 84*a*.

Figure 11:
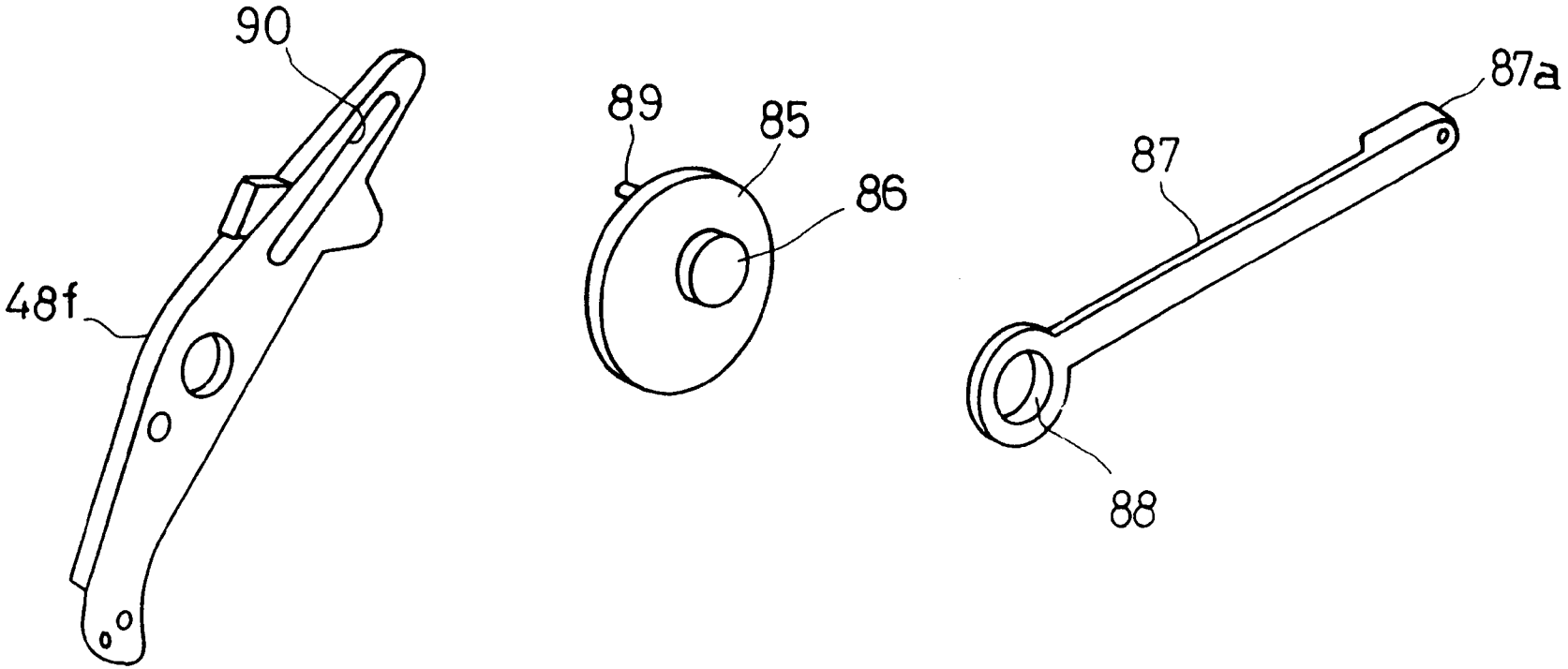
FIG. 11 is a disintegrated perspective view of a part of the movement transformation mechanism.

As understood more clearly from FIG. 11, on one face of the circular plate member 85 are provided a short columnar projecting shaft 86 at an eccentric position and a circular hole 88 provided on one end of a connecting rod 87 is fitted to the projecting shaft 86 rotatably. The connecting rod 87 extends rearward from the projecting shaft 86 and a rear end of the rod 87 is pivoted to an upper end of the thigh portion 48*r* of the rear leg 47. The thigh portion 48*r* is pivoted to the trunk part 39 of the model horse 13 by the pivot 51. Accordingly, when the circular plate member 85 turns around the axis of the shaft 84*a*, the connecting rod 87 reciprocates back and forth while swinging up and down to swing the thigh portion 48*r* around the shaft 51 back and forth.

On the other side of the circular plate member 85 is projected an engaging pin 89 at a peripheral portion. On the one hand, a long slit 90 is formed at an inner end part of the thigh portion 48*f* of the front leg 46 which has a intermediate portion pivotally supported to the trunk part 39 by the pivot $51_1$. The engaging pin 85 is engaged with the slit 90. Accordingly, when the circular plate member 85 turns as mentioned above, the thigh portion 48*f* is driven by the circular plate member 85 through the engaging pin 89 and the slit 90 to swing about the pivot 51, back and forth.

The positional relation between the projecting shaft 86 and the engaging pin 85 on the circular plate member 85 is set so as to give a coordinate swinging movement for simulating the leg opening-closing motion of an actual horse, and the thigh portions 48, the leg portions 46 and the foot portions 50 of the legs 46, 47 are properly connected by members such as the aforementioned connecting rod 52 (FIG. 2) so as to simulate movement of legs of the actual horse. Thus, by driving the circular plate member 85 from the first drive shaft 41 through the worm 81, the worm wheel 82 and the gears 83, 84, the front leg 46 and the rear leg 47 repeat coordinate leg opening-closing motions to simulate running of the horse.

Figure 12:
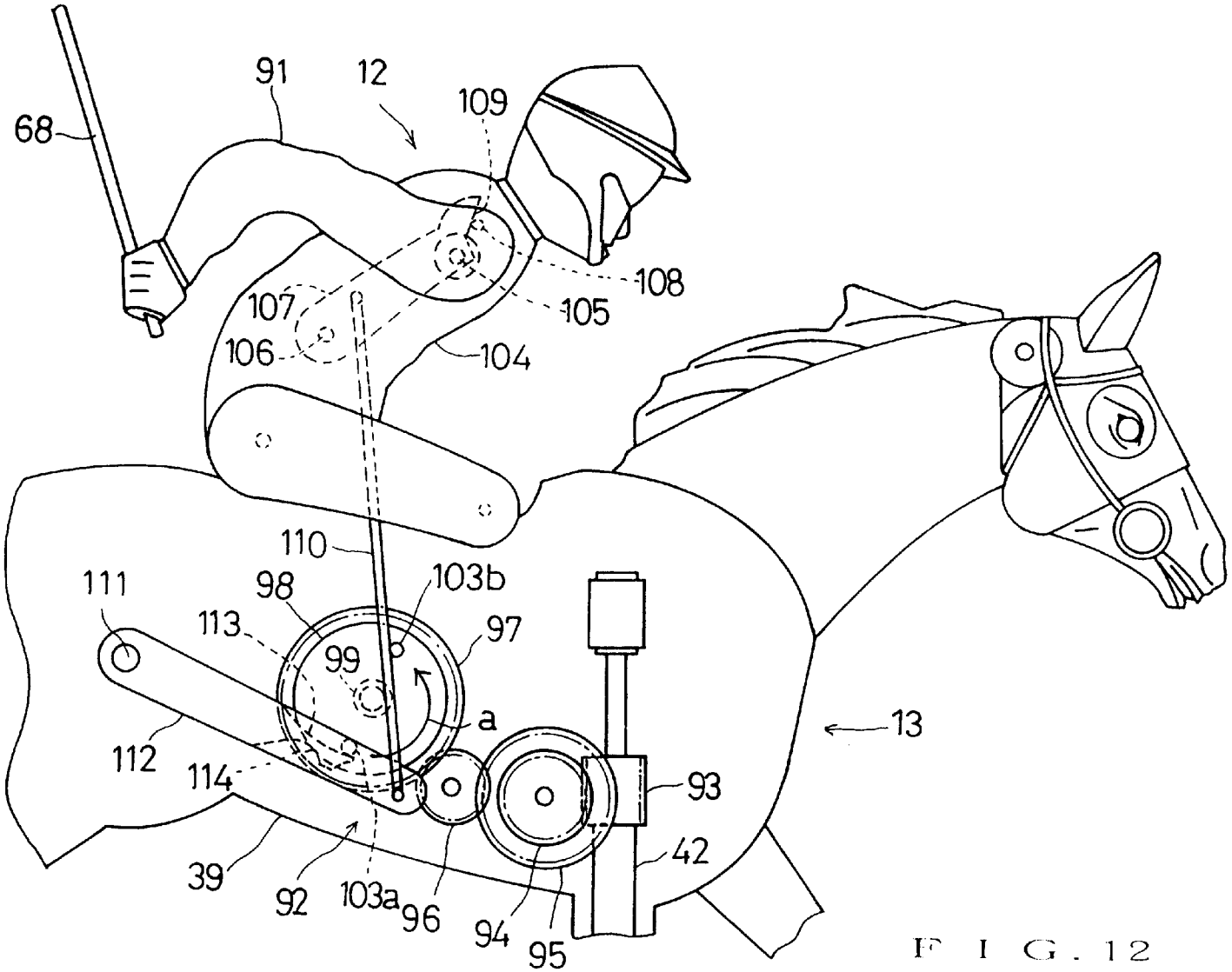
FIG. 12 is a side view showing another movement transformation mechanism for simulating motion of the jockey.

FIG. 12 is a side view showing the other preferred embodiment of the movement transformation mechanism for simulating motion of the jockey. This figure corresponds to one of the model running body (13, 12) of FIG. 10 viewed from the opposite side and as for the model jockey 12 the side of the hand 91 with the whip 68 is shown.

Figure 13:
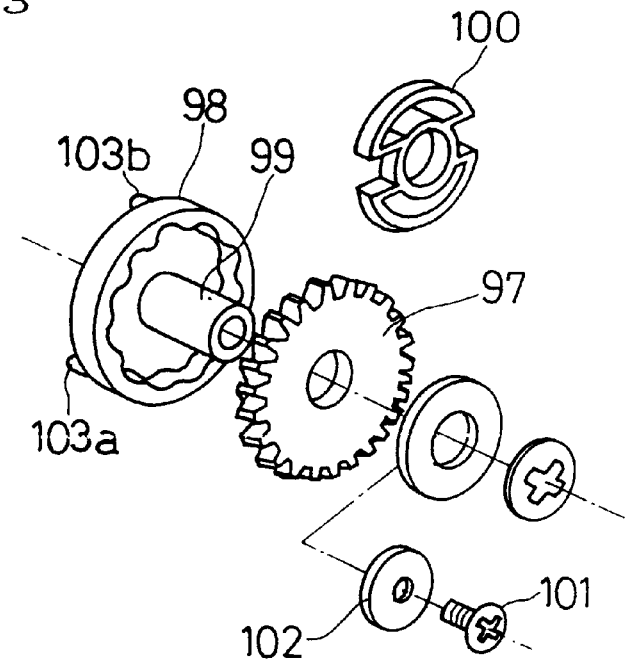
FIG. 13 is a disintegrated perspective view of a part of the movement transformation mechanism.

The movement transformation mechanism 92 for simulating motion of the jockey in the present embodiment is constituted as follows. The worm 93 provided on the second drive shaft 42 is meshed with a worm wheel 94 and a drive gear 95 coaxial with the worm wheel 94 is meshed with a driven gear 97 through an intermediate gear 96. The driven gear 97 is rotationally fitted to a shaft 99 which is integral with a circular plate member 98 (see FIG. 13). The circular plate member 98 is pivoted to the trunk part 39 of the model horse 13 so as to rotate.

A friction piece 100 (FIG. 13) is pinched between the driven gear 97 and the circular plate member 98 and the driven gear 97 is pressed toward the circular plate member 98 through a washer 102 by a screw 101 screwed into the shaft 99. Therefore, rotation of the driven gear 97 is transmitted to the circular plate member 98 through friction force of the friction piece 100 and when a resistant force on the circular plate member 98 side is larger than the friction force of the friction piece 100, the driven gear 97 runs idle with respect to the circular plate member 98. On a face of the circular plate member 98 opposite to the driven gear 97 are projected pins 103*a*, 103*b* at peripheral two positions opposite to each other on a diameter.

A base end portion of the hand 91 of the model jockey 12 is swingably pivoted to an upper portion (shoulder portion) of the body part 104 of the model jockey 12 by a pivot 105. In the neighborhood of the pivot 105, a pin 108 is projected from the above-mentioned base end portion. The body part 104 is provided with a lever member 107. The lower end of the lever member 107 is pivoted by a pivot 106 to an intermediate portion of the body part 104 below the pivot 105, and at an upper end portion of the lever member 107 is provided an engaging face 109 for engaging with the pin 108. In addition, on a middle part of the lever member 107 and at a position near to the pivot 106, an upper end of a rod member 110 is pivotally held. The rod member 110 extends toward the neighborhood of the circular plate member 98 at the lower part.

Figure 14:
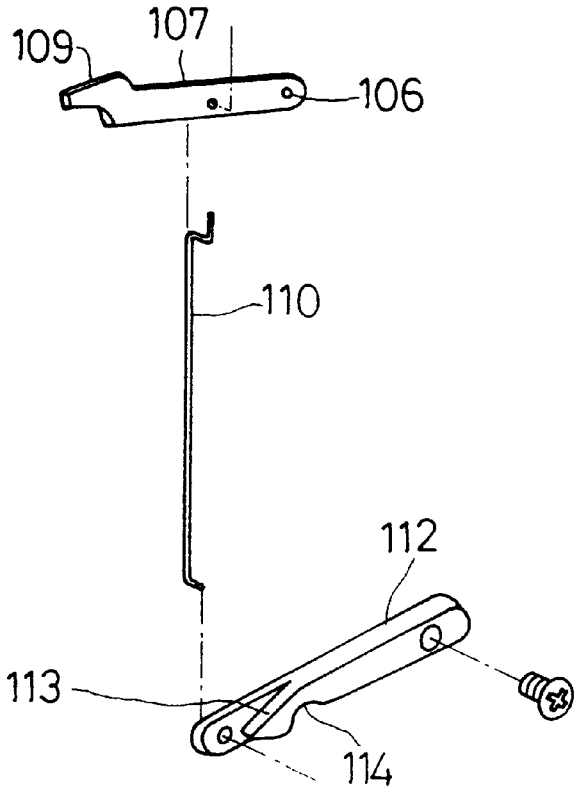
FIG. 14 is a disintegrated perspective view of another part of the movement transformation mechanism.

The lower end of the rod member 110 is pivotally held at a front end of a lever member 112 which has a rear end pivoted to the trunk part 39 by a pivot 111 coaxial with the pivot 51 of the rear leg thigh portion 48*r*. FIG. 14 is a disintegrated perspective view of the above members 107, 110, 112 viewed from the opposite side to FIG. 12. As understood from FIGS. 12, 14, on a surface of the lever member 112 facing to the circular plate member 98 is formed an arcuate upward cam face 113 having a large radius of curvature, stepwise. On an under side of the cam face 113 is formed a recess 114 of an arcuate shape having a small radius of curvature.

FIG. 12 shows a state when the model jockey 12 swings up the whip 68. In this state, the hand 91 tends to rotate counterclockwise about the pivot 105 by the self weight, and the rotational force is transmitted to the lever member 107 through engagement of the pin 108 and the engaging face 109, further to the lever member 112 from the lever member 107 through the rod member 110. Accordingly, the lever member 112 is forced so as to swing upward about the pivot 111. However, the upward swing motion of the lever member 112 is prevented by engagement of the pin 103*a* and the cam face 113 so that the hand 91 is held at the upper position as shown in FIG. 12.

Since the circular plate member 98 is being driven to rotate counterclockwise as shown by the arrow a, immediately after the illustrated state, the pin 103*a* disengages from the cam face 113 to allow free swinging of the lever member 112, so that the hand 91 swings downward about the pivot 105 by self weight to simulate a whip down motion. The lever member 112 swings upward and at an upper position of the lever member 112, another pin 103*b* engages with the cam face 113 from above. After that the lever member 112 is pressed downward by the pin 103*b* in accordance with rotation of the circular plate member and the hand 105 swings upward about the pivot 105 to be brought in the whip up position of FIG. 12 again, then the same motions are repeated. That is, by continuous rotation of the circular plate member 98 in the direction shown by the arrow a the hand repeats up-and-down movements to simulate the whipping motion.

Figure 15:
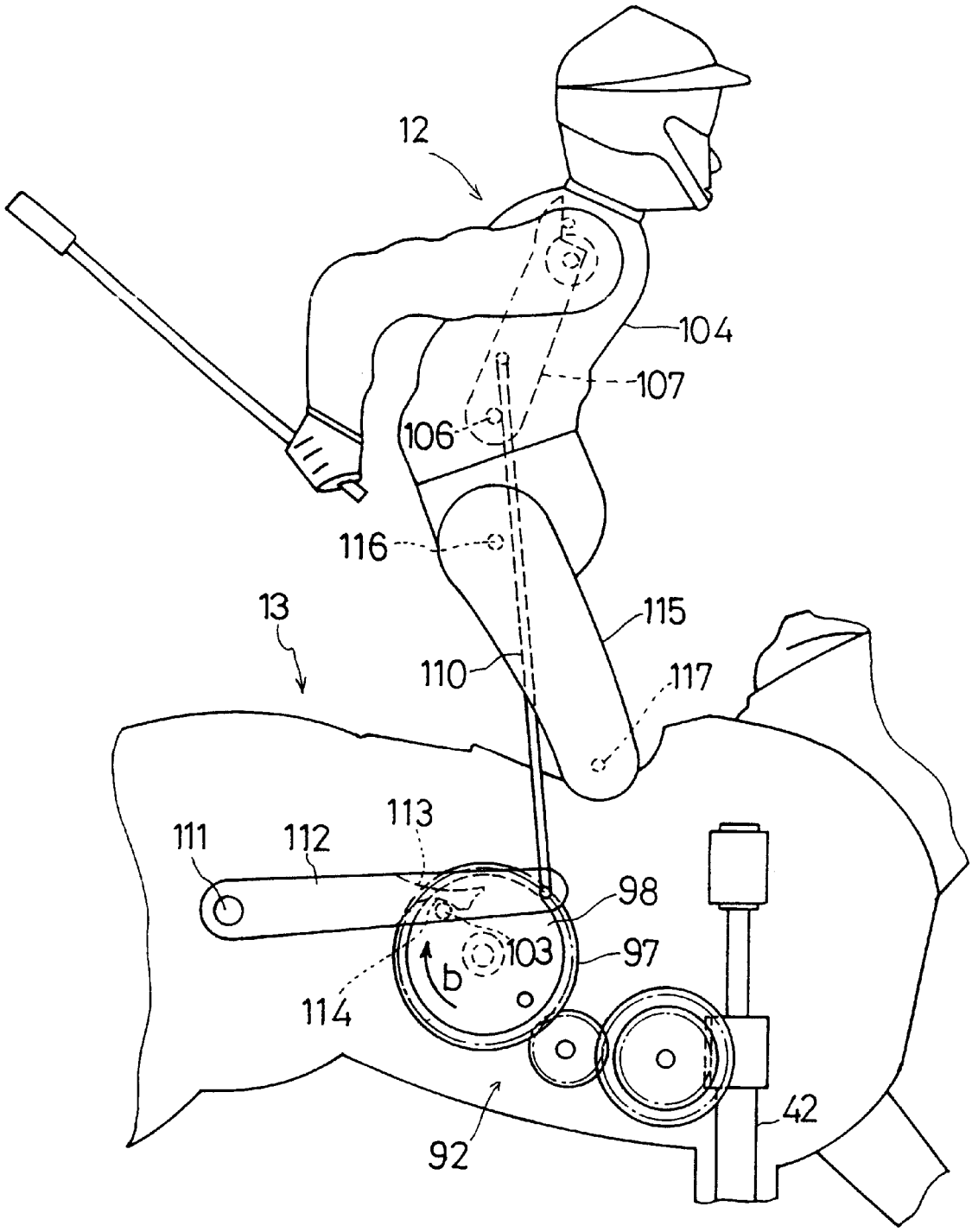
FIG. 15 is a view similar to FIG. 12 showing a state when the jockey stands up.

In the above movement transformation mechanism 92, if the second drive shaft 42 turns reversely, the model jockey 12 stands up on the model horse 13 as shown in FIG. 15. In this case, since the circular plate member 98 turns in the direction shown by the arrow b (FIG. 15) contrary to the aforementioned whipping case, either pin 103 is engaged with the recess 114 positioned below the cam face 113 from below so that the lever member 112 swings up to further upper position compared to the aforementioned whipping case. As a result, the pivot 106 is pushed up largely upward through the rod member 110 and the lever member 107 and the model jockey 12 stands up as shown in FIG. 15. The body part 104 and the leg part 115 of the model jockey 12 are connected with each other by a pivot 116 and the lower end of the leg part 115 is connected with the trunk part 39 of the model horse by a pivot 117.

In the state of FIG. 15, since the pin 103 is fitted into the recess 114 having a small radius of curvature, it cannot turn in the direction of arrow b while pushing up the lever member 112. Therefore rotation of the circular plate member 98 is prevented. However, since the circular plate member 98 and the driven gear 97 are engaged with each other through the friction piece 100, there occurs a slip between the both and the driven gear 97 continues to turn. And the model jockey 12 maintains the standing posture shown in FIG. 15. When the turning direction of the second drive shaft is changed so that the driven gear 97 and the circular plate member 98 are turned in the direction shown by the arrow a in FIG. 12 again, the pin 103 disengages from the recess 114, engages with the upper cam face 113 and returns to the state of FIG. 12.

Since the movement transformation mechanisms 80, 92 are composed of a small number of parts, light and compact, they can be arranged within the model jockey 12 and the trunk part of the model horse 13 and the cost is reduced.

INDUSTRIAL APPLICABLITY

The present invention can be utilized for a running simulation apparatue in a game apparatus simulating a horse race, a car race, a boat race, a motorcycle race or the like, or an amusement apparatus on which a plurality of individuals such as simulated members of a drum and fife band move independently of each other.

We claim:

1. A running simulation apparatus having a model running body simulating a running body running with various motions placed on a running plate so as to run, a carrier capable of freely running arranged under said running plate, and magnets provided on a lower face of said model running body and on an upper face of said carrier respectively for drawing said model running body by said carrier through a magnetic attractive force acting between said magnets, comprising:

a plurality of magnets capable of turning about a vertical axis provided on said model running body at a regular interval;

a plurality of magnets capable of turning about a vertical axis provided on said carrier at a regular interval;

turning drive means provided on said carrier for driving said magnets of the carrier side to turn; and a movement transformation mechanism provided on said model running body for transforming turning movement of said magnets of the model running body side into a predetermined motion of a predetermined part of said model running body.

2. A running simulation apparatus as claimed in claim 1, wherein each of said magnets of the carrier side is provided with said turning drive means respectively, and each of said magnets of the model running body side is provided with said movement transformation mechanism respectively.

3. A running simulation apparatus as claimed in claim 1 or 2, wherein a control means for controlling said turning drive means in real time independently of running speed of said carrier.

4. A running simulation apparatus as claimed in claim 1 or 2, wherein said magnets of the carrier side is adapted to be driven in both normal and reverse directions by said turning drive means.

5. A running simulation apparatus as claimed in claim 1 or 2, wherein said movement transformation mechanism comprises a drive shaft drivingly connected to one of said magnets of the model running body side for transmitting rotational movement of said magnet;

a circular plate member drivingly connected to said drive shaft to turn having a projecting shaft projected at an eccentric position on a face and an engaging pin projected at a peripheral portion on another face; and a connecting rod having an end pivotally fitted to said projecting shaft, another end of said connecting rod being connected to a motion member of said model running body, said engaging pin being engaged with a slit formed on another motion member of said model running body.

6. A running simulation apparatus as claimed in claim 1 or 2, wherein said movement transformation mechanism comprises a drive shaft drivingly connected to one of said magnets of the model running body side for transmitting rotational movement of said magnet;

a circular plate member drivingly connected to said drive shaft to turn having a pin projected at a peripheral portion on a face;

a lever member having an end pivoted to a main body part of said model running body and another end with a free end portion extending along said face of said circular plate member;

a connecting member for connecting a motion member of said model running body with said another end of said lever member; and a forcing means for forcing said lever member in one direction, said pin being engaged with said lever member to swing said lever member against said forcing means at a part of a rotational locus when said circular plate turns.

7. A running simulation apparatus as claimed in claim 6, wherein a driven gear connected to said drive shaft through gears is arranged on a side of said circular plate member opposite to said lever member and faces of said driven gear and said circular plate member are frictionally engaged with each other.

8. A running simulation apparatus as claimed in claim 1, having means for detecting alignment of said model running body and said carrier which comprises a magnet piece attached on a lower surface of said model running body and a hall effect device provided on a position of said carrier opposite to said magnet piece.

9. A running simulation apparatus as claimed in claim 1, wherein a plurality of said model running bodies are placed on said running plate, a plurality of said carriers are arranged corresponding to said model running bodies respectively and each of said model running bodies is independently controlled by a corresponding respective carrier.

10. A running simulation apparatus as claimed in claim 9, wherein each of said model running bodies is independently drawn by said corresponding respective carrier to compete for order of finish.

* * * * *